US010100536B2

(12) United States Patent
Hernandez et al.

(10) Patent No.: US 10,100,536 B2
(45) **Date of Patent: *Oct. 16, 2018**

(54) MODULAR PANEL SYSTEM PARTICULARLY FOR BELOW GRADE APPLICATIONS

(71) Applicants: Jaime Hernandez, West Islip, NY (US); Ira Sumkin, Amityville, NY (US)

(72) Inventors: Jaime Hernandez, West Islip, NY (US); Ira Sumkin, Amityville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/614,770

(22) Filed: Jun. 6, 2017

(65) Prior Publication Data

US 2017/0321437 A1 Nov. 9, 2017

Related U.S. Application Data

(63) Continuation of application No. 15/182,022, filed on Jun. 14, 2016, now Pat. No. 9,714,516.

(60) Provisional application No. 62/175,512, filed on Jun. 15, 2015.

(51) Int. Cl.

| | |
|---|---|
| ***E04F 19/06*** | (2006.01) |
| ***E04F 19/04*** | (2006.01) |
| ***E04F 13/08*** | (2006.01) |

(52) U.S. Cl.

CPC ..... *E04F 19/065* (2013.01); *E04F 13/0832* (2013.01); *E04F 19/0436* (2013.01); *E04F 19/0463* (2013.01)

(58) Field of Classification Search

CPC . E04F 19/065; E04F 19/0436; E04F 19/0463; E04F 13/0832

USPC ..... 52/287.1

See application file for complete search history.

(56) References Cited

U.S. PATENT DOCUMENTS

| | | | |
|---|---|---|---|
| 684,497 | A | 10/1901 | Davies |
| 3,991,537 | A | 11/1976 | Brown |
| 4,143,496 | A | 3/1979 | Destito |
| 4,724,638 | A | 2/1988 | Bezborodko |

(Continued)

FOREIGN PATENT DOCUMENTS

| | | |
|---|---|---|
| CA | 2246918 | 6/1999 |
| DE | 4141289 | 6/1993 |
| JP | 01314156 A | 12/1989 |

*Primary Examiner* — Brent W Herring

(74) *Attorney, Agent, or Firm* — Thomas A. O'Rourke; Bodner & O'Rourke, LLP

(57) ABSTRACT

A modular wall panel system includes a pair of specially formed receiver strips, base and crown moldings, and a panel. The receiver strips are respectively mounted at selective upper and lower wall locations. Each receiver strip has an elongated base for mounting to the wall, and first and second flanges protruding therefrom, with each flange having a pair of apices particularly formed and located thereon. The crown and base moldings have bottom and rear surfaces, an inward facing ornate/sculpted surface, and a mating flange configured to cantilever away from the rear surface. The mating flange includes a pair of apices that are configured to be mated between the first and second flanges of the receiver strip, and be retained by its flange apices. The receiver strip also spaces the rear surface of the moldings away from the wall/studs, for the panel to be inserted behind the rear surface of each.

15 Claims, 25 Drawing Sheets

(56) References Cited

U.S. PATENT DOCUMENTS 5,179,811 A 1/1993 Walker
5,561,960 A 10/1996 Minnick
5,623,800 A 4/1997 Shinkosky
5,894,701 A 4/1999 Delorme
6,138,423 A 10/2000 Poutanen
6,173,542 B1 1/2001 Wright
6,202,377 B1 3/2001 Krieger
6,276,101 B1 8/2001 Schiedegger
6,341,461 B1 * 1/2002 Crowley ..... E04F 13/10 52/311.2
6,345,480 B1 * 2/2002 Kemper ..... E04F 19/061 403/118
6,588,165 B1 7/2003 Wright
6,751,915 B2 6/2004 Crowley
7,168,474 B2 1/2007 Crowley
7,770,352 B2 8/2010 Plasek
7,810,289 B2 10/2010 Montgomery
7,926,232 B2 4/2011 de Raucourt
7,987,648 B1 8/2011 Ryan
8,166,716 B2 5/2012 MacDonald
8,316,599 B2 11/2012 Griffiths
8,522,498 B2 9/2013 Picken
8,572,915 B2 11/2013 Meahl
8,584,417 B1 11/2013 Krieger
8,631,617 B2 1/2014 Janesky
8,739,483 B1 6/2014 Bilge
8,763,335 B2 * 7/2014 Krieger ..... E04B 2/08 52/311.2
8,763,355 B2 7/2014 Krieger
8,887,459 B2 11/2014 Wheeler
9,059,348 B1 * 6/2015 Quinlan ..... H01L 31/05
9,206,612 B2 12/2015 Gosling
9,714,516 B1 * 7/2017 Hernandez ..... E04F 19/065
2003/0029109 A1 2/2003 Hellberg
2004/0148893 A1 8/2004 Kornfalt
2004/0250500 A1 * 12/2004 Lam ..... A47H 2/00 52/716.1
2006/0070329 A1 4/2006 Schiltz
2006/0080939 A1 4/2006 Bledsoe
2006/0207197 A1 * 9/2006 Anderson ..... E04F 19/024 52/211
2007/0022682 A1 1/2007 Morgenegg
2007/0034341 A1 2/2007 Lam
2007/0094998 A1 5/2007 Gomez Insa
2008/0216428 A1 9/2008 Carvalhais
2008/0295439 A1 * 12/2008 Janesky ..... E04B 1/7023 52/589.1
2009/0077922 A1 * 3/2009 Pettine ..... E04B 2/7457 52/698
2009/0241444 A1 10/2009 Griffiths
2009/0293392 A1 12/2009 Dykstra
2009/0313931 A1 * 12/2009 Porter ..... B32B 5/18 52/309.4
2010/0000168 A1 1/2010 Weiser
2011/0078974 A1 4/2011 Mitchell
2011/0094174 A1 * 4/2011 Meahl ..... E04F 19/04 52/288.1
2011/0179733 A1 * 7/2011 Picken ..... E04F 19/02 52/242
2012/0077890 A1 * 3/2012 Mancosh ..... C04B 16/06 521/68
2012/0255249 A1 10/2012 Singh
2014/0215939 A1 8/2014 Gosling
2014/0227509 A1 * 8/2014 Gillman ..... E04C 2/243 428/319.1
2015/0033656 A1 2/2015 Geels
2015/0052838 A1 * 2/2015 Ritchie ..... E04C 3/29 52/408
2016/0024789 A1 * 1/2016 Pence ..... E04C 2/34 52/479
2016/0053500 A1 2/2016 Kawalec
2016/0076248 A1 * 3/2016 Gillman ..... B32B 5/16 52/586.1
2017/0101343 A1 * 4/2017 Zheng ..... C04B 28/30
2017/0321437 A1 * 11/2017 Hernandez ..... E04F 19/0463

* cited by examiner

MODULAR PANEL SYSTEM PARTICULARLY FOR BELOW GRADE APPLICATIONS

CROSS REFERENCE TO RELATED APPLICATIONS

This application is a continuation of U.S. patent application Ser. No. 15/182,022, filed on Jun. 14, 2016, which claims priority on U.S. Provisional Application Ser. No. 62/175,512, filed on Jun. 15, 2015, all disclosures of which are incorporated herein by reference.

FIELD OF THE INVENTION

The present invention relates to a new and improved paneling system, and more particularly to a backing component that is usable for supporting trim pieces and wall panels in an easily installed modular arrangement.

BACKGROUND OF THE INVENTION

In both residential and commercial building construction, the walls of a below-grade foundation must be finished to form a living space or a business or workspace. Typically, for residential homes, the basement walls are formed from poured concrete, and sometimes from cinderblocks or concrete blocks that are cemented together. These concrete walls may first be waterproofed through the application of a sealant, and then must have a plurality of framing members attached over the concrete. The framing members may each be in the form of a wood stud, which may be conventional 2×4 studs, or may instead be 2×2 strips or even furring strips. Alternatively, the framing member may be a PVC stud. The framing members provide a gap to accommodate electrical wiring, any necessary plumbing, and thermal insulation. The size for the framing members used may affect the type and amount of insulation that can be used.

Conventional construction next requires that plasterboard (i.e., drywall) be fastened to the framing members on the walls, using drywall screws or nails, which is similarly done for the wall studs of a room for above-grade construction. The drywall fasteners driven in below the surface of the drywall, the joints between the sheets of the drywall (typically 4×8 sheets), and the joints at the corners of the room, will next be covered with one or more layers of a joint compound ("mud"). The joints will also require an application of one or more layers of tape or drywall mesh, before applying the joint compound, which serves to prevent cracks along the joint lines. The joint compound must later be sanded to be smooth with respect to the surface of the drywall.

The sanding process produces a significant amount of fine white power on the floor, which must be cleaned up, and produces airborne particulates, which constitute a serious health hazard, as the Centers for Disease Control maintains that prolonged exposure to the silica therein increases the risk of lung cancer, or may just cause breathing problems and may aggravate asthma. Therefore, it is strongly recommended that the person performing the work should wear a respiratory mask and goggles while sanding the drywall, and while vacuuming up the powder.

Once the mudded drywall joints and nail holes have been sanded smooth, the walls must be primed and painted. Prior to painting, the stud locations should be conveniently marked at the extremes of the wall, or on the floor, because the next step is to nail the base molding and crown molding thereto, which must be nailed to the framing members, as the drywall does not provide sufficient support. A chair rail molding may also be nailed to the framing members at the appropriate above-floor height, if desired.

This process is very labor intensive and time consuming, particularly because the layers of joint compound require a sufficient amount of time to dry before the sanding can occur, and because of the time required to clean up after the sanding is competed, which may need to be done one or more times.

The present invention greatly simplifies the process of constructing a finished interior surface, once the framing members are applied over the concrete wall, and eliminates the powder, the particulates, and the associated health hazards. The present invention furthermore permits ease of replacement, or the cleaning of a wall section, and provides easy access behind a wall section to fix or add electrical wiring, etc.

OBJECTS OF THE INVENTION

It is an object of the invention to provide a new and improved wall panel and molding arrangement to replace a conventional drywall installation and associated taping and mudding.

It is a further object of the invention to provide a new and improved wall panel and molding arrangement configured to replace nailed moldings.

It is another object of the invention to provide a new and improved wall panel and molding arrangement configured for ease of installation.

It is also an object of the invention to provide a new and improved wall panel and molding arrangement configured to provide ease of access behind the finished wall to permit repairs or installation of new wiring thereat.

It is another object of the invention to provide a new and improved wall panel and molding arrangement that is modular.

It is also an object of the invention to provide a new and improved wall panel and molding arrangement configured to replace an existing wall that had been finished with drywall.

Further objects and advantages of the invention will become apparent from the following description and claims, and from the accompanying drawings.

SUMMARY OF THE INVENTION

A modular wall panel system may broadly include a pair of specially formed receiver strips, base molding, crown molding, and other types of molding as well, and a panel. The receiver strips may be respectively mounted at a selective upper and a selective lower location on the wall. Each receiver strip may broadly include an elongated base used to mount the strip to the wall, from which may protrude a first flange and a second flange, with each of the flanges having a pair of apices particularly formed and located thereon. The first and second flanges of each receiver strip may protrude from the base along an entire length of the base, or may instead protrude intermittently from the base.

The crown molding and the base molding, as well as the other molding types utilized herein in conjunction with a receiver strip, may broadly include at least a bottom surface, a rear surface, and an inward facing ornate/sculpted surface, and a mating flange configured to cantilever away from the rear surface to a free end thereof. The mating flange of each molding broadly includes a pair of apices that are configured to be mated between the first and second flanges of the receiver strip, and be retained by the flange apices of the receiver strips.

The receiver strip may also serve to space the rear surface of the crown molding and base molding away from the wall/studs. The panel may then be inserted behind the rear surface of the crown molding, when mated with the receiver strip at the selective upper wall position, and may then dropped down behind the rear surface of the base molding, when mated with the receiver strip at the selective lower wall position.

The panel used may be a composite panel formed of: a three mm thick Magnesium Oxide board, a one mm thick PVC backing sheet, and a closed cell Polyisocyanurate foam sandwiched therebetween. Each of the receiver strips may be formed of a rigid polyvinylchloride material, and the base molding and crown molding may be formed of a celuka polyvinylchloride.

DETAILED DESCRIPTION OF THE INVENTION

As used throughout this specification, the word "may" is used in a permissive sense (i.e., meaning having the potential to), rather than the mandatory sense (i.e., meaning must). Similarly, the words "include", "including", and "includes" mean including but not limited to.

The phrases "at least one", "one or more", and "and/or" are open-ended expressions that are both conjunctive and disjunctive in operation. For example, each of the expressions "at least one of A, B and C", "one or more of A, B, and C", and "A, B, and/or C" mean all of the following possible combinations: A alone: or B alone; or C alone: or A and B together; or A and C together; or B and C together; or A, B and C together.

Also, all references (e.g., patents, published patent applications, and non-patent literature) that are cited within this documents are incorporated herein in their entirety by reference.

Furthermore, the described features, advantages, and characteristics of any particular embodiment disclosed in the following specification, may be combined in any suitable manner with any of the other embodiments disclosed herein.

Figure 1:
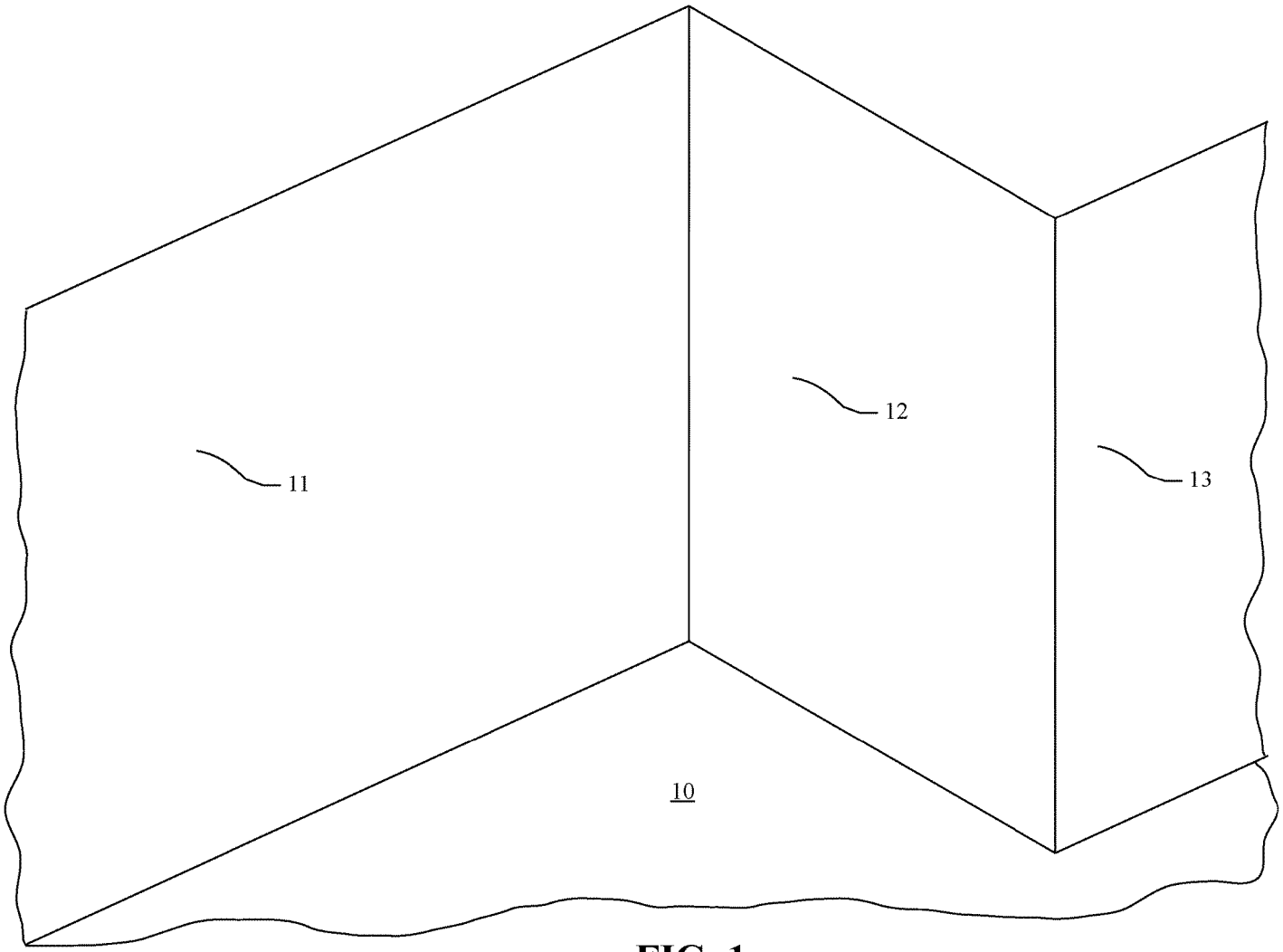
FIG. 1 is a perspective view showing several below-grade concrete walls and a floor.
Figure 2:
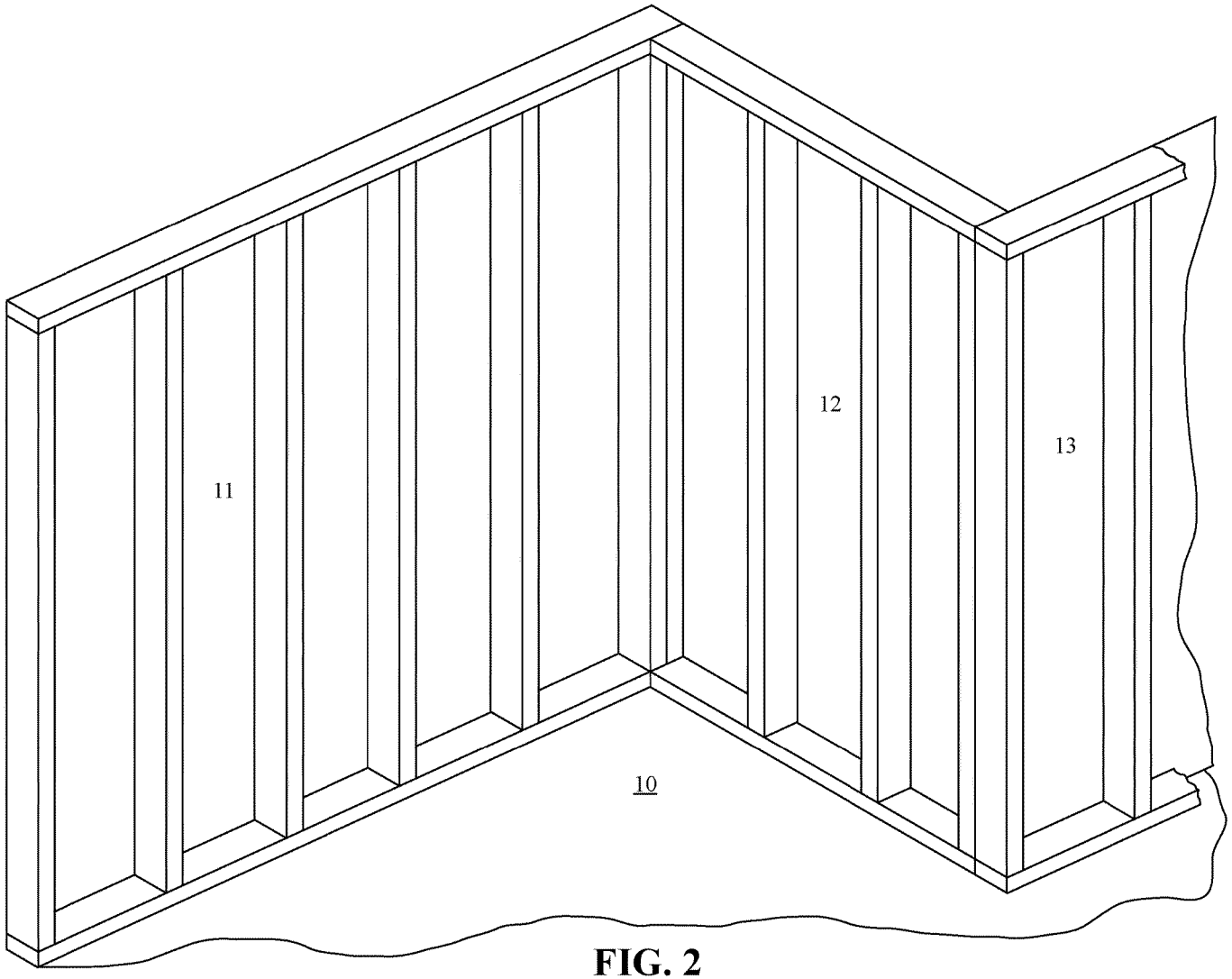
FIG. 2 shows the perspective view of FIG. 2, but after a plurality of framing members have been attached over the concrete walls to prepare to finish the interior space.

FIG. 1 is a perspective view showing below-grade concrete walls 11, 12, and 13, and a sub-floor 10 of a building, upon which the owner desires to have a finished interior wall surface. FIG. 2 illustrates the walls 11, 12, and 13 of FIG. 1, after a plurality of framing members have been attached thereto, which may be conventional 2×4 studs, or may instead be 2×2 strips or even furring strips. Ordinarily, the building's owner would finish the wall through the labor intensive process of fastening plasterboard (i.e., drywall) to the studs using screws or nails, taping and mudding the joints, and mudding all of the fastener heads as well, and then sanding and priming and painting the unfinished drywall. The process is quite messy, as sanding of the mudded portions produces large quantities of dust, which must be cleaned, and the particulates from the sanding process may pose a serious health hazard as a result of inhalation and prolonged exposure.

The present invention is particularly adapted to eliminate the drawbacks of installing conventional drywall, and makes use of unique molding pieces and a panel, which may be supported by a receiver strip, in accordance with the following disclosure.

Figure 3:
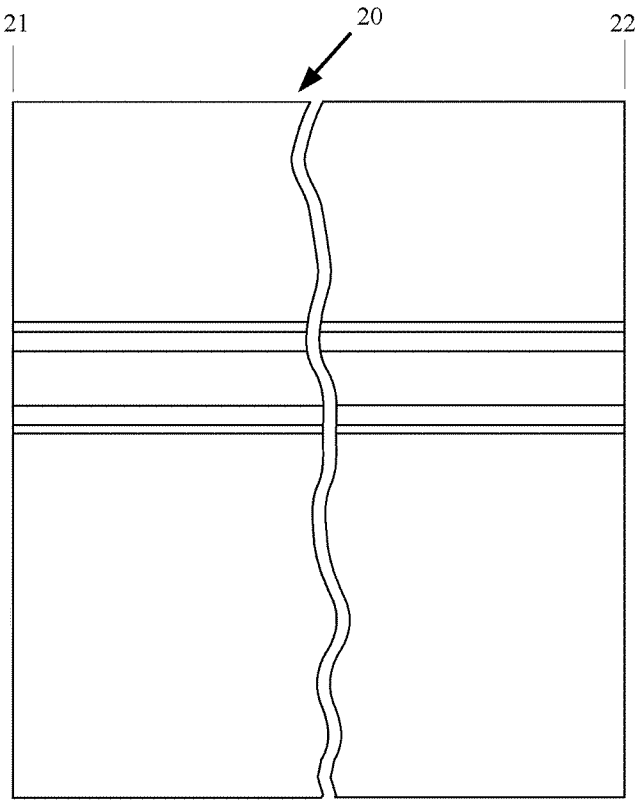
FIG. 3 is a front view of a receiver of the present invention.
Figure 4A:
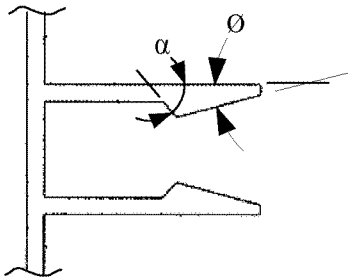
FIG. 4A is an enlarged detail view of the flanges of the receiver shown in the cross-sectional view of FIG. 4.
Figure 4:
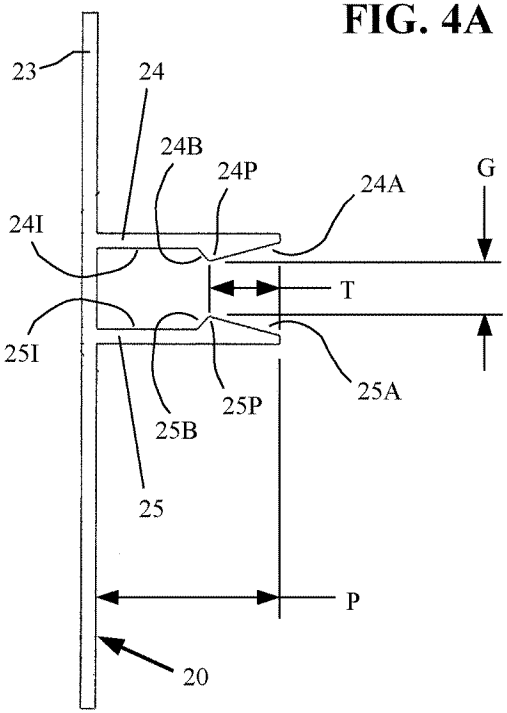
FIG. 4 is a cross-sectional view through the receiver of FIG. 3.

A first embodiment of a receiver strip 20 in accordance with the present invention is shown in FIGS. 3-4, and may be formed of various different materials, including but not limited to, a rigid PVC (polyvinylchloride). The receiver strip 20 may extend from a first end 21 to a second end 22, and may be formed to include a base 23, from which may protrude a first flange 24 and a second flange 25. In the cross-sectional view of FIG. 4, the flanges 24 and 25 appear to be a pair of prongs, however, each of the flanges 24 and 25 may extend from the base 23 throughout the full length/extent of the strip 20 (i.e., the flanges may be as long as the base), or alternatively the flanges may extend from the base intermittently, or the flanges may extend from the base according to any other desired pattern/frequency, including being spaced at regular or irregular intervals. Merely to be exemplary, the flanges 24 and 25 are shown throughout the figures as extending the full length of the strip 20, from first end 21 to second end 22.

As seen in FIG. 4, each of the flanges 24 and 25 may protrude from the base 23 to a distance P, and each may have a pair of tapered surfaces formed thereon, which face each other. Flange 24 may have a tapered surface 24A that may begin at the free end of the flange (i.e., at height P) and may be at an angle θ to increase the thickness of the flange. The tapered surface 24A may transition into a second tapered surface 24B, which may be at an angle α to taper back to the nominal thickness of the flange, and may thus form an apex 24P.

The flange 25 may similarly have tapered surfaces 25A and 25B formed thereon to create an apex 25P, and these surfaces may generally mirror the tapered surfaces of flange 24.

The tapered surfaces 24A and 25A on flanges 24 and 25 may each preferably be at a fairly shallow angle, and the angle θ shown in FIG. 4A may be roughly 15-20 degrees. The tapered surfaces 24B and 25B on flanges 24 and 25 may each preferably be at a steeper angle, and angle α may even be 90 degrees; however, in one embodiment tapered surfaces 24B and 25B may be oriented for angle α to be roughly 55 degrees, which may be sufficient to secure the moldings of the present invention thereto, while also permitting its removal with the application of a reasonable amount of force, as discussed hereinafter. The interior surfaces 241 and 251 of the flanges 24 and 25 may be at a desired distance apart. Also, the tapered surfaces 24A and 25A on flanges 24 and 25 may have a length that in combination with the flange-to-flange distance produces a desired gap G between the apex 24P and apex 25P, which is also discussed hereinafter.

Figure 5:
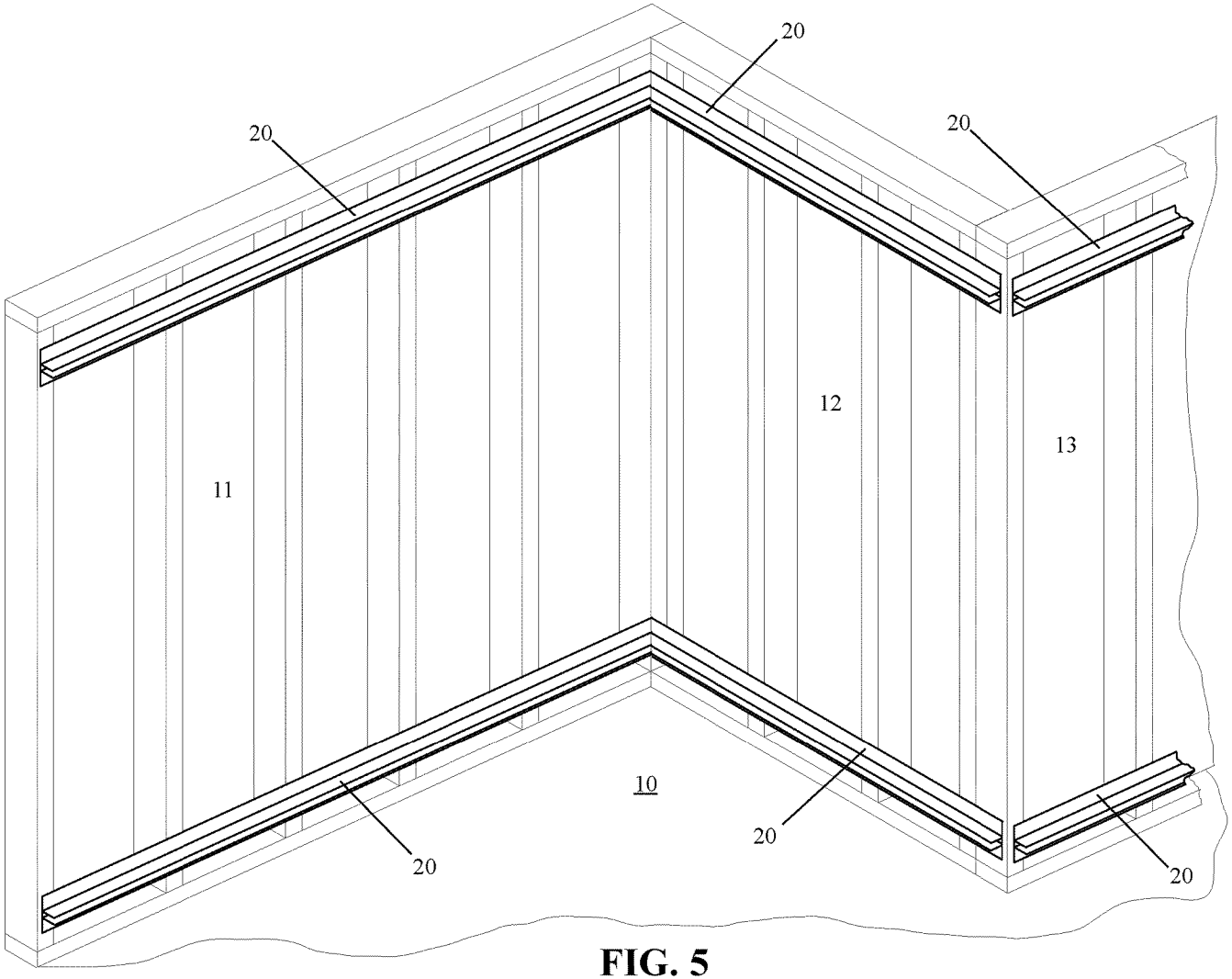
FIG. 5 shows the perspective view of FIG. 2, but after a plurality of the receiver strips of FIG. 3 have been secured thereto to receive a base molding and a crown molding.
Figure 6:
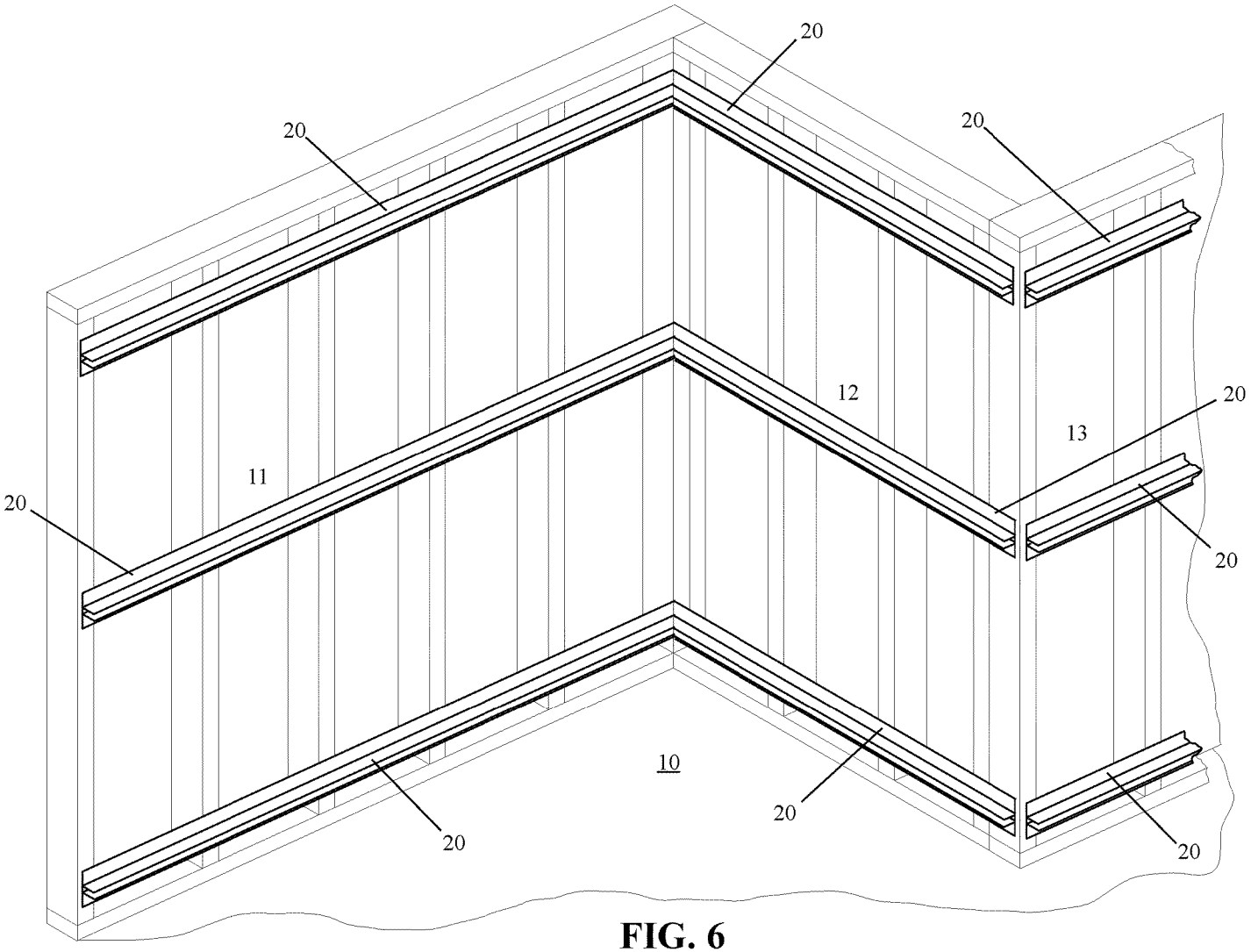
FIG. 6 shows the perspective view of FIG. 5, but after a plurality of the receiver strips of FIG. 3 have been secured thereto to receive a chair rail molding.

As seen in FIG. 5, a receiver strip 20 may be secured to each of the upper and lower portions of walls 11, 12, and 13, at a select distance away from the ceiling and the subfloor 10. In addition, as seen in FIG. 6, a receiver strip may also be secured to middle portions of walls 11, 12, and 13, if a chair rail molding is desired. If the panel system is to be used on only a single wall of a room, the upper and lower receiver strip 20 may each be cut to be substantially the same length as the wall, being slightly smaller to prevent the strip from being wedged between the adjacent walls. If, as seen in FIG. 5, the panel system is to be used on multiple walls of the room, which would entail paneling/finishing an inside corner, the upper and lower receiver strip 20 may each be cut to be slightly smaller than the length of the wall, and to accommodate the adjacent receiver strips 20 in a miter-type joint, the flanges 24/25 at its ends positioned at the inside corner may also be beveled at a 45 degree angle. Rather than forming a miter joint, the flanges 24/25 at the end of one of the receiver strips may be trimmed shorter than its base, to clear the flanges 24/25 of the adjacent receiver strip.

To be able to produce a finished interior wall, a specially configured molding is used with (i.e., joined to) the receiver strips 20. These specially configured moldings are shown within FIG. 7 through FIG. 31.

Figure 7:
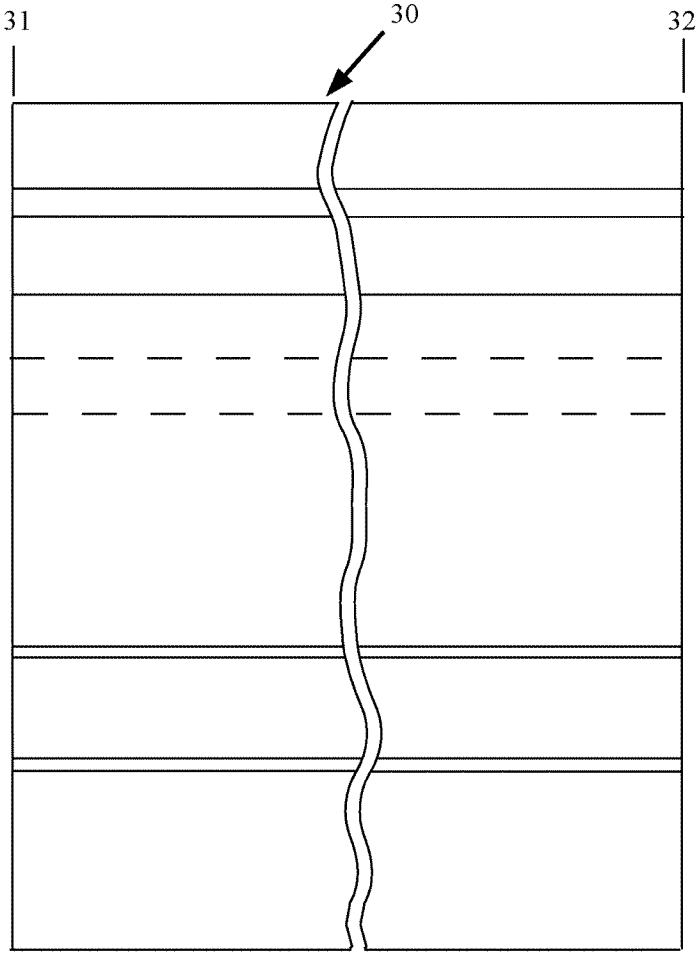
FIG. 7 is a front view of a base molding in accordance with the present invention.
Figure 8:
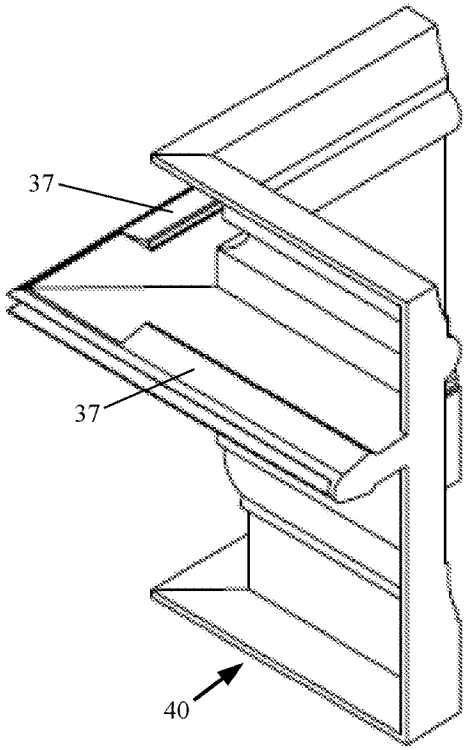
FIG. 8 is a perspective view of a base molding formed to finish out an inside corner.
Figure 10:
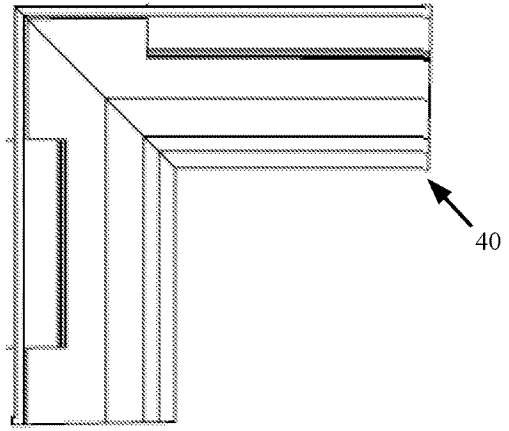
FIG. 10 is a top view of the base molding inside corner shown in FIG. 8.
Figure 9:
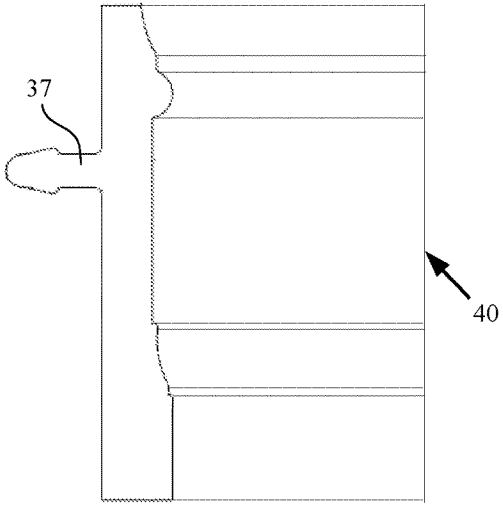
FIG. 9 is a front view of the base molding inside corner shown in FIG. 8.
Figure 12:
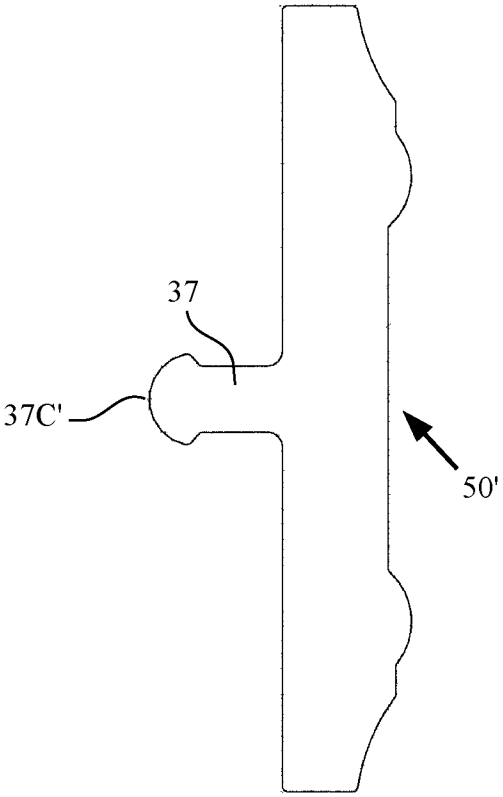
FIG. 12 is a cross-sectional view of an alternate embodiment of the chair rail molding shown in FIG. 11.
Figure 11:
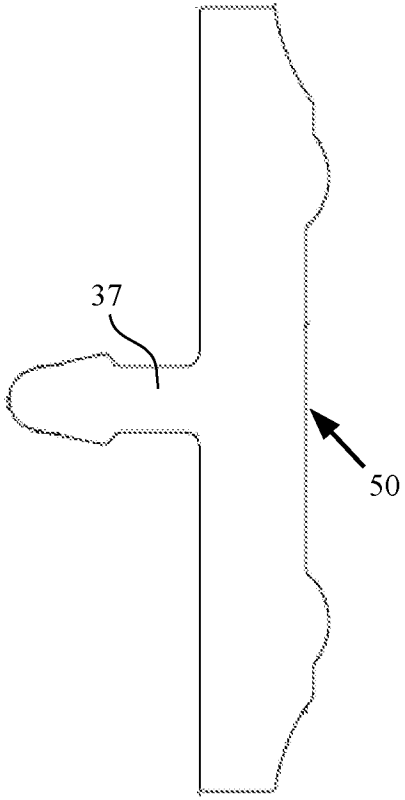
FIG. 11 is a cross-sectional view of a chair rail molding in accordance with the present invention.
Figure 13:
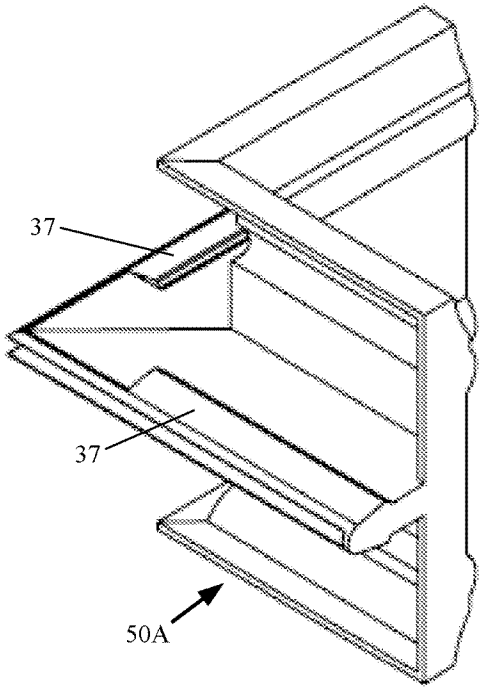
FIG. 13 is a perspective view of a chair rail molding formed to finish out an inside corner.
Figure 15:
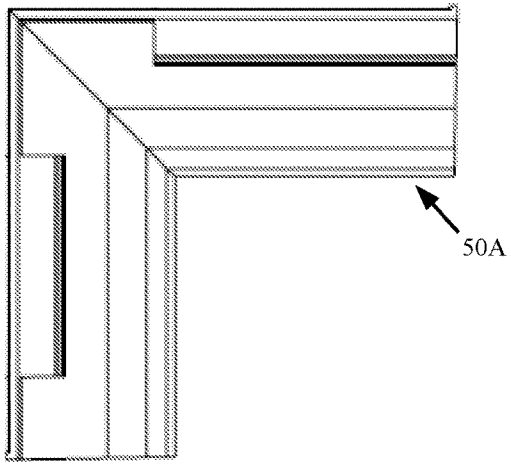
FIG. 15 is a top view of the chair rail molding inside corner shown in FIG. 13.
Figure 14:
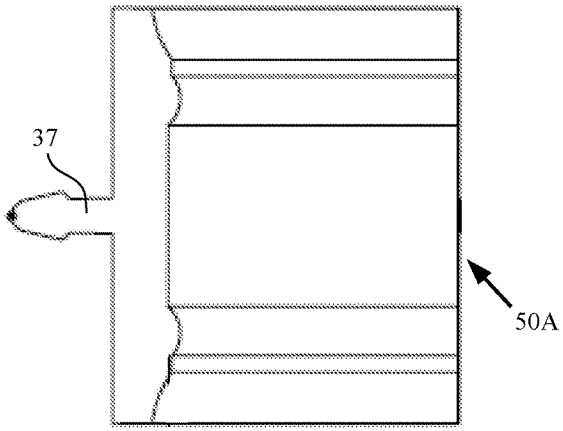
FIG. 14 is a front view of the chair rail molding inside corner shown in FIG. 13.
Figure 17:
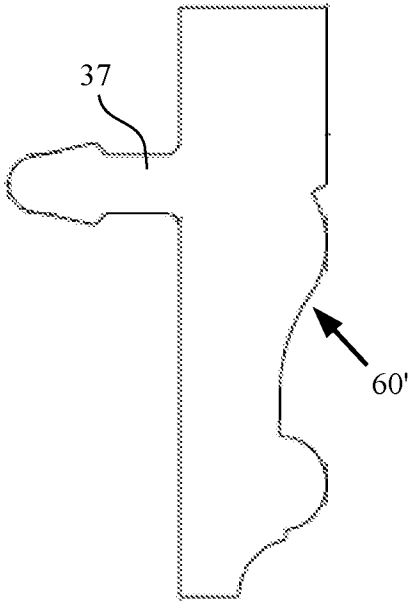
FIG. 17 is a cross-sectional view of an alternate embodiment of the casing molding shown in FIG. 16.
Figure 16:
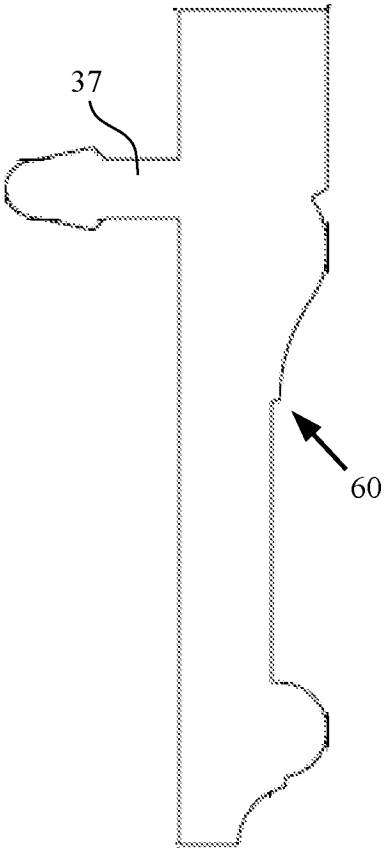
FIG. 16 is a cross-sectional view of a casing molding in accordance with the present invention.
Figure 18:
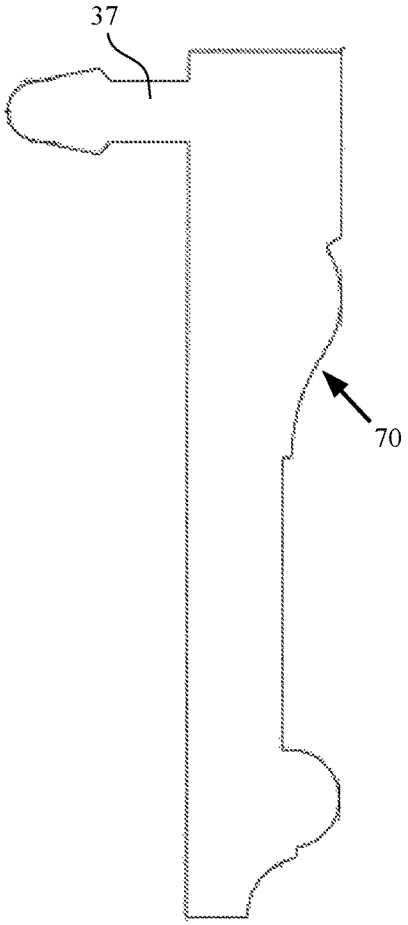
FIG. 18 is a cross-sectional view of a crown molding in accordance with the present invention.
Figure 19:
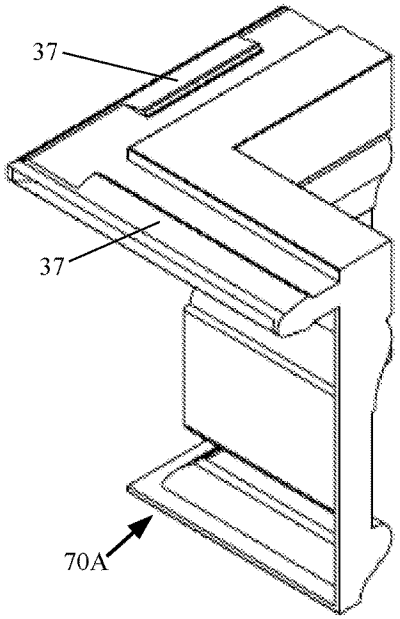
FIG. 19 is a perspective view of a crown molding formed to finish out an inside corner.
Figure 20:
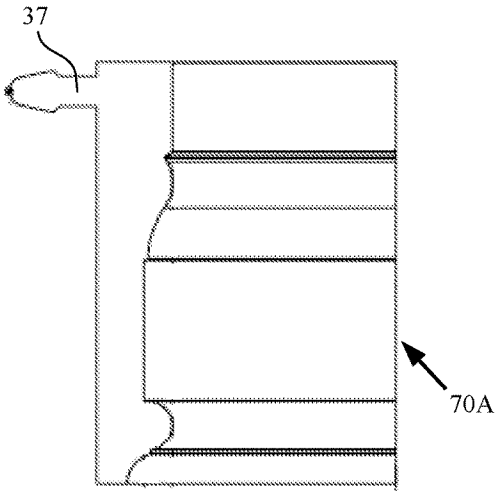
FIG. 20 is a front view of the crown molding inside corner shown in FIG. 19.
Figure 21:
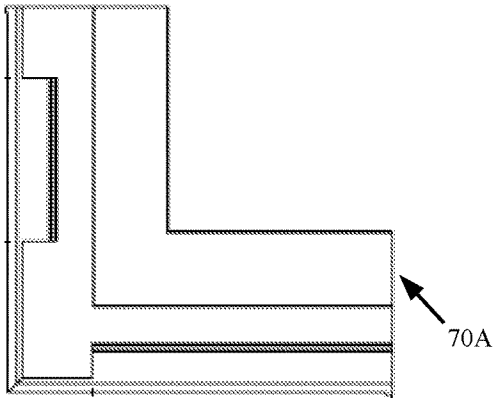
FIG. 21 is a top view of the crown molding inside corner shown in FIG. 19.
Figure 22:
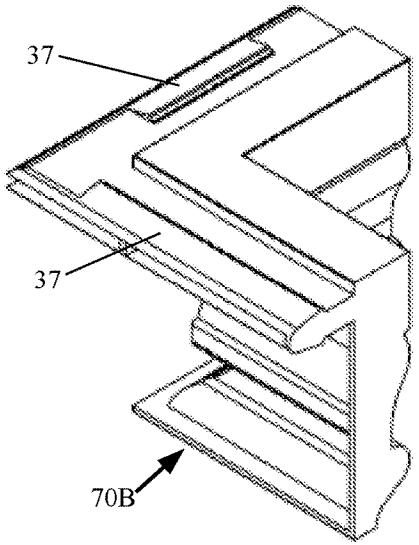
FIG. 22 is a perspective view of an alternate embodiment of the crown molding inside corner of FIG. 19, having a reduced height.
Figure 24:
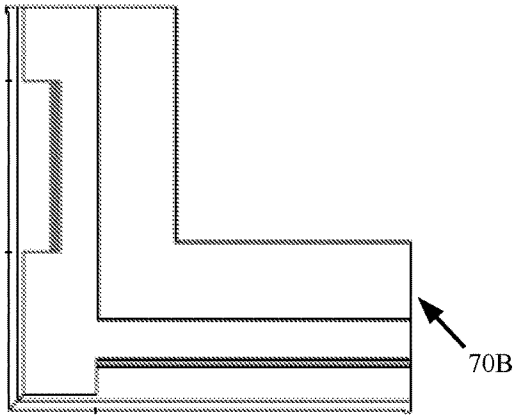
FIG. 24 is a top view of the crown molding inside corner shown in FIG. 22.
Figure 23:
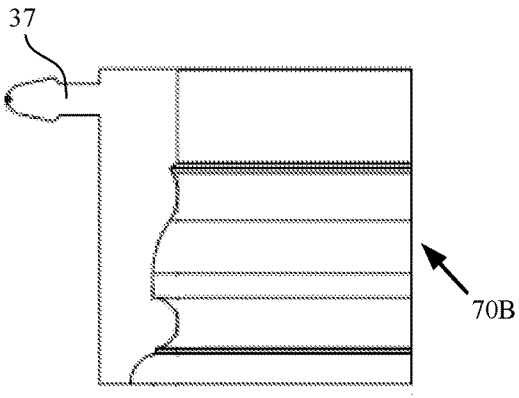
FIG. 23 is a front view of the crown molding inside corner shown in FIG. 22.
Figure 25:
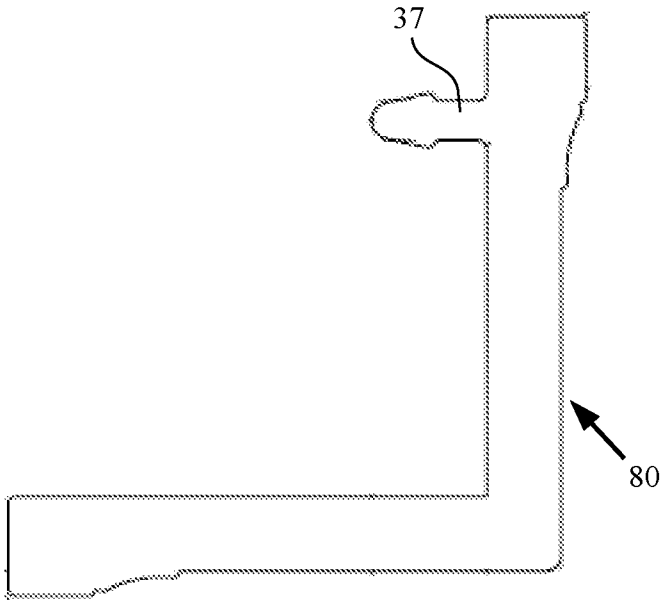
FIG. 25 a cross-sectional view of a corner molding formed in accordance with the present invention.
Figure 27:
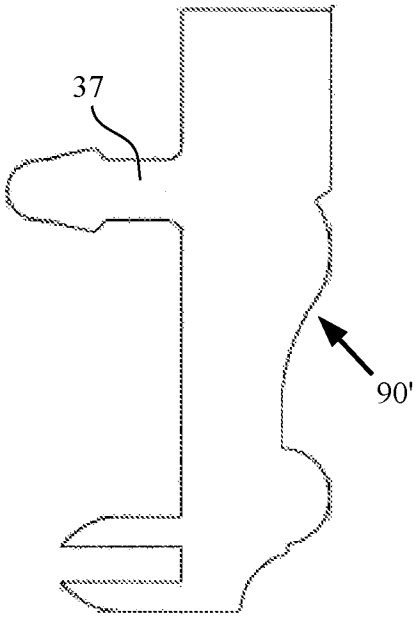
FIG. 27 is a cross-sectional view of an alternate embodiment of the window molding of FIG. 25, having a reduced height.
Figure 26:
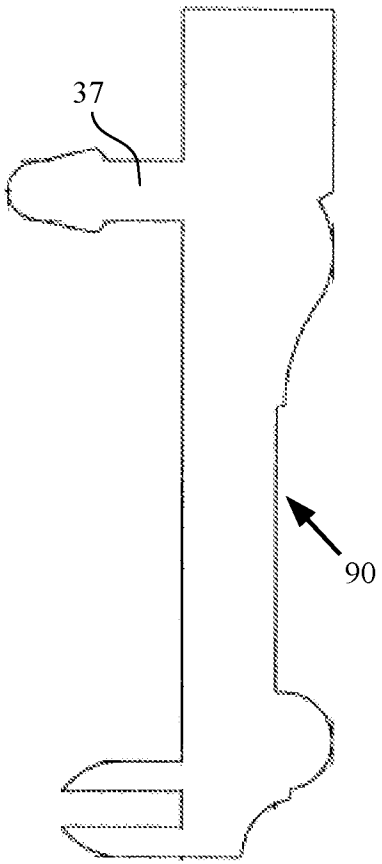
FIG. 26 is a cross-sectional view of a window molding in accordance with the present invention.
Figure 28:
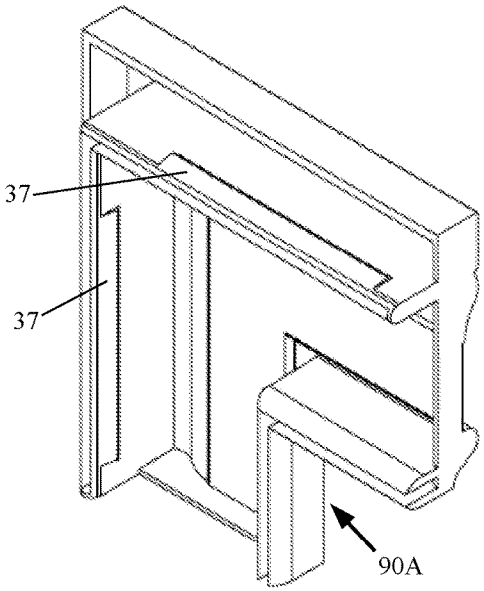
FIG. 28 is a perspective view of a window molding formed to finish out an inside corner.
Figure 31:
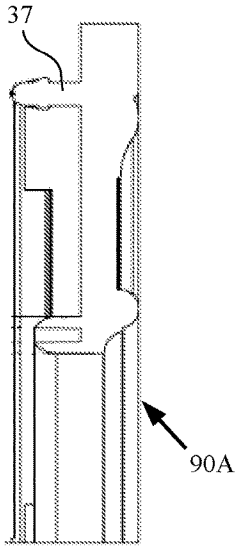
FIG. 31 is an end view of the window molding inside corner shown in FIG. 28.
Figure 30:
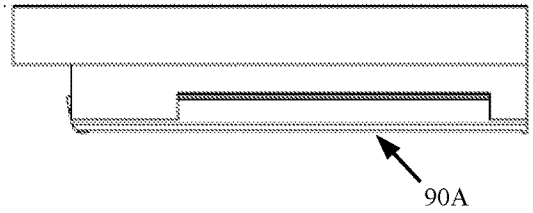
FIG. 30 is a side view of the window molding inside corner shown in FIG. 28.
Figure 29:
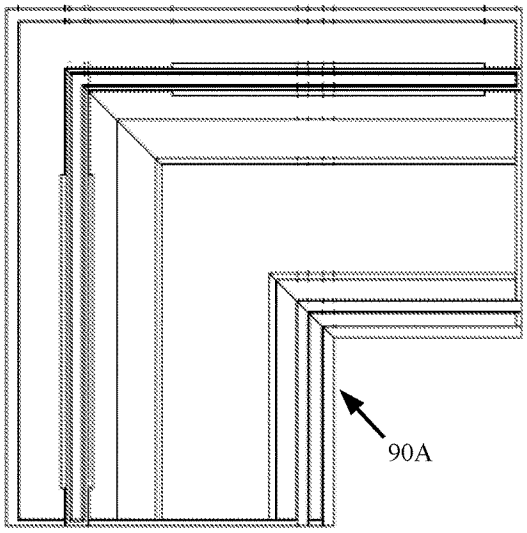
FIG. 29 is a top view of the window molding inside corner shown in FIG. 28.

FIG. 7 shows a straight base molding 30 of the present invention. FIGS. 8-10 show a base molding 40 formed to finish out an inside corner. FIG. 11 and FIG. 12 each show a straight chair rail molding (50 and 50') in accordance with the present invention. FIGS. 13-15 show a chair rail molding 50A formed to finish out an inside corner. FIGS. 16 and 17 each show a straight casing molding (60 and 60') formed in accordance with the present invention, which may be used for doors. FIG. 18 shows a straight crown molding 70 in accordance with the present invention. FIGS. 19-21 show a crown molding 70A formed to finish out an inside corner. FIGS. 22-24 show another crown molding 70B formed to finish out an inside corner, and having a reduced height. FIG. 25 shows corner molding 80 in accordance with the present invention. FIGS. 26-27 show a window molding 90 and 90' in accordance with the present invention (note the pair of prongs shown therein may be used to receive a piece of 3 mm PVC to produce a finished look in basement window box). FIGS. 28-31 show a window molding 90A formed to finish out an inside corner.

The straight molding sections may be formed of various different materials, including but not limited to, a celuka PVC (Polyvinyl chloride). Also the corner moldings may similarly be formed of various different materials, including but not limited to, ABS plastic.

Figure 7A:
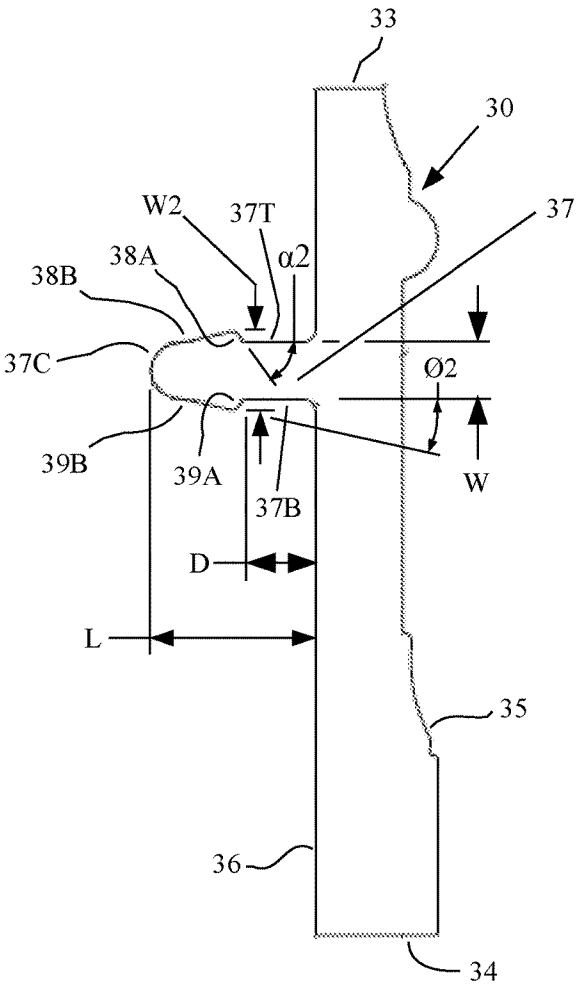
FIG. 7A is a cross-sectional view of the base molding of FIG. 7.

The base molding of FIGS. 7-7A is discussed in detail, and its flange feature is similarly found on the other moldings shown throughout the other figures. As seen in FIGS. 7-7A, the base molding 30 may extend from a first end 31 to a second end 32, and may have a top surface 33, and a bottom surface 34, which may generally be flat. The base molding 30 may also have a sculpted surface 35 which is intended to face inward into the room, and may be as ornately sculpted as desired, and which may also subsume the top surface, which may be curved. The base molding 30 may also have a substantially flat rear surface 36, from which may protrude a flange 37 of width W, which should be the same as, or slightly smaller than, the gap G of the receiver strip 20, because the flange 37 is configured to mate with the corresponding flanges 24 and 25 of the receiver strip.

The flange 37 may protrude to a length L, which may be the same as, or is more preferably slightly smaller than, the protruding distance P of the flanges 24/25 of the receiver strip 20. The flange 37 may generally be straight, except that the flat top and bottom surfaces 37T and 37B may transition to surfaces 38A and 39A, which taper outwardly and may be configured to match the corresponding surfaces 24B and 25B of the receiver strip 20 (i.e., may be at roughly the same angle). The distance D between the start of the tapered surfaces 38A/39A and the surface 36 may be the same as the distance T for the tapered surfaces 24A/25A shown in FIG. 4 for the receiver 20. To ensure proper engagement between those surfaces, as seen in FIG. 33A, the distance D may be slightly larger than the distance T. The surfaces 38A and 39A may each transition into a second pair of tapered surfaces 38B and 39B, which may be at an angle configured so that they taper towards each other, and may terminate in a radiused corner surface 37C. Alternatively, the tapered surfaces 38A and 39A may transition directly into a curved surface 37C', as seen in FIG. 12. The distance W2, between the apex where surface 38A meets surface 38B and the apex where surface 39A meets surface 39B, should be the same as, or may preferably be slightly smaller than, the desired gap distance G2 between the inside surfaces 241 and 251 of the flanges 24 and 25 of the receiver 20.

It should be noted that the flange 37 and its associated features, when used on a molding formed to finish an inside corner (e.g., FIGS. 8-10, FIGS. 13-15, etc.), may protrude from both vertical members therein, and may terminate before reaching the corner, or may instead, as seen throughout the Figures herein, converge to form a right angle.

Figure 32:
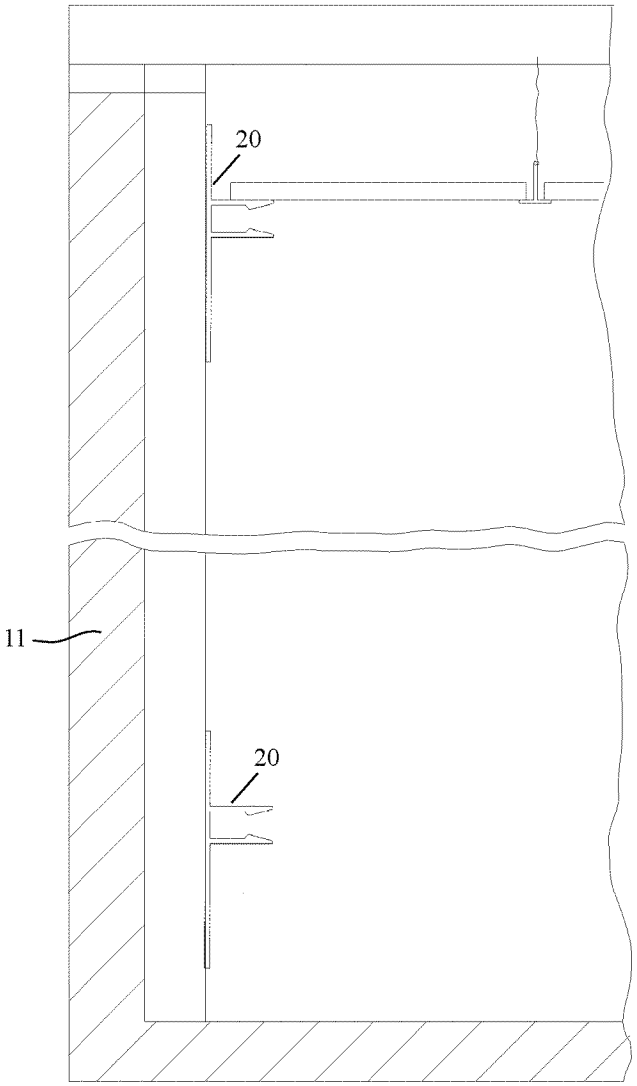
FIG. 32 is a cross-sectional view through the framed concrete wall of FIG. 5, with receiver strips attached at suitable upper and lower locations, and with the upper receiver strip supporting one end of a drop ceiling panel.
Figure 32A:
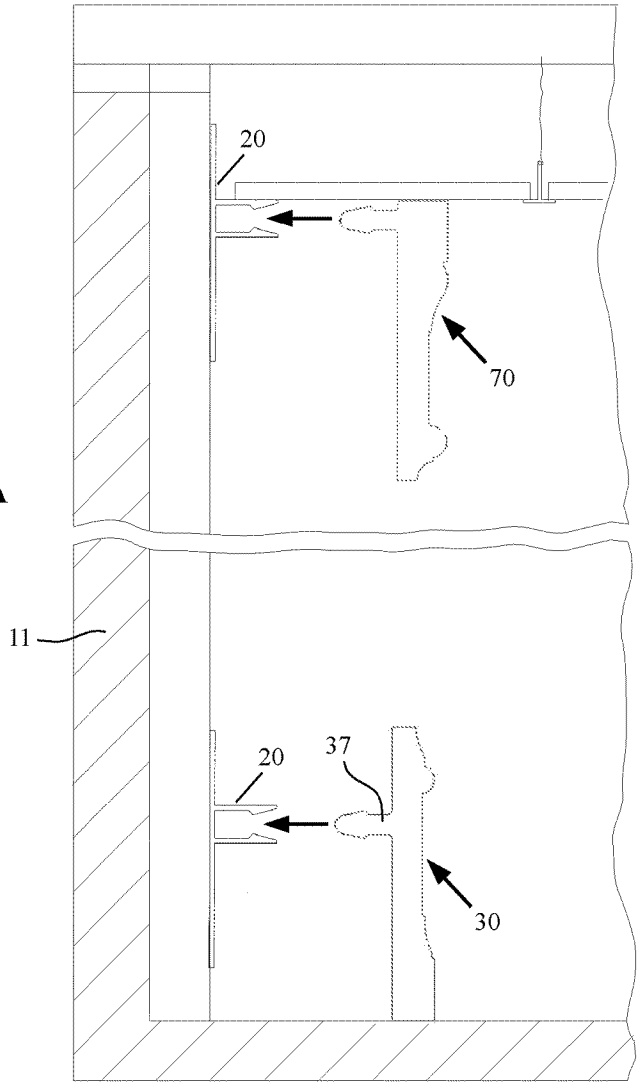
FIG. 32A is a cross-sectional view through the framed concrete wall of FIG. 5, with the receiver strips shown attached at a suitable upper and a lower location, just prior to respective engagement therewith by a section of crown molding and a section of base molding.

FIG. 32 shows a cross-sectional view through the framed concrete wall 11 of FIG. 5, with the receiver strips 20 shown attached at a suitable upper and a lower location. The receiver strips 20 may be secured to the framing members using, for example, framing screws, and may be located using a template, or by measuring to ensure being secured at the proper height. FIG. 32A shows the same cross-sectional view as in FIG. 32, but just prior to respective engagement therewith by a section of crown molding 70 and a section of base molding 20. As may be seen therein, the flange 37 of each of the pieces of molding are configured to be mated with the two flanges of the respective receiver 20. The receiver strip 20 mounted at the upper location may be used to support the end of an adjacent drop ceiling panel. If a drop ceiling panel is not used with the molding and panels of the present invention, a portion of, or all of the upper flange of the base 23 of the receiver 20 may be scored and snapped off, so that the receiver strip may be properly positioned with respect to the ceiling.

Figure 33:
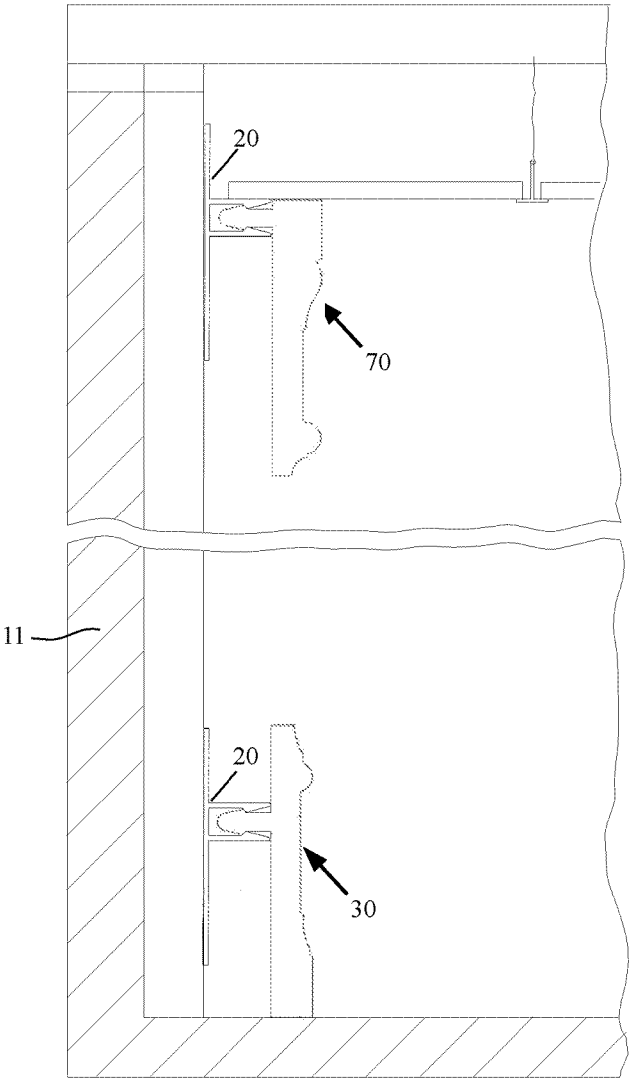
FIG. 33 is the cross-sectional view of FIG. 32, after the flanges of the crown molding and base molding have been inserted into the flanges of the respective receiver strips.
Figure 33A:
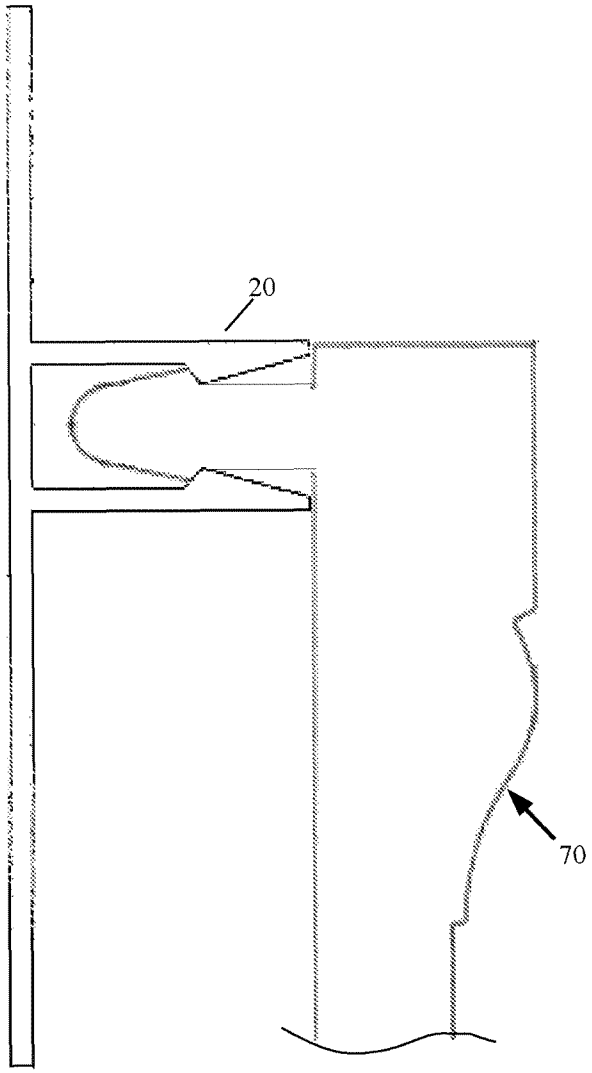
FIG. 33A is an enlarged detail view of the engagement shown in FIG. 33 between the flange of the crown molding and two respective apices of the flanges of the base.

FIG. 33 shows the cross-sectional view of FIG. 32, after the respective flanges 37 of the sections of crown molding 70 and base molding 20 have been inserted into the flanges of the respective receiver strips.

Figure 34:
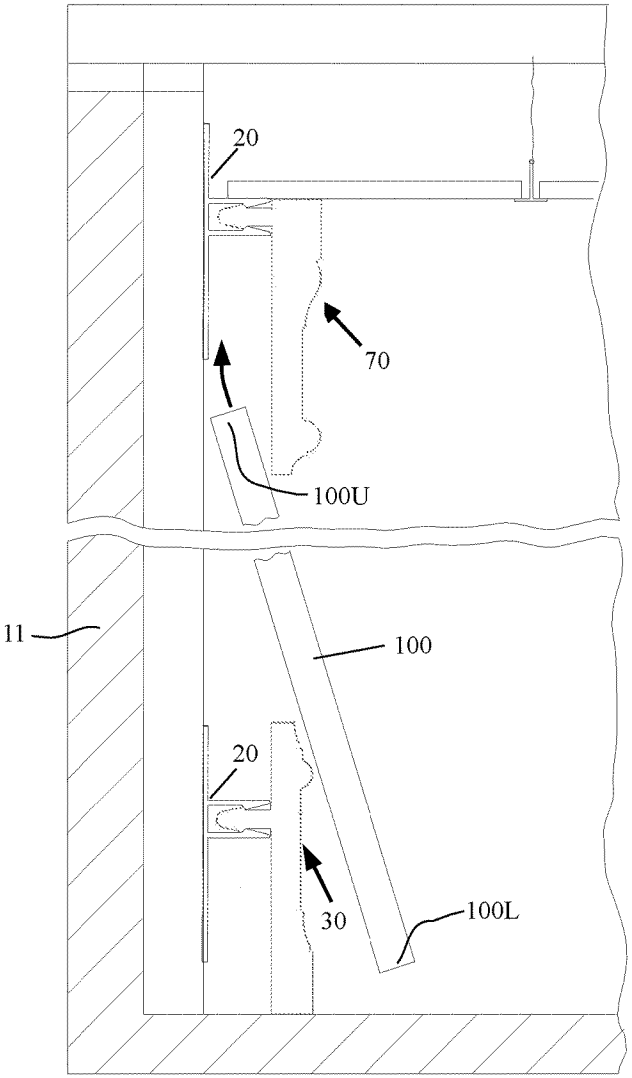
FIG. 34 is the cross-sectional view of FIG. 33, showing a panel of the present invention with its upper end initially being inserted behind the crown molding.
Figure 34A:
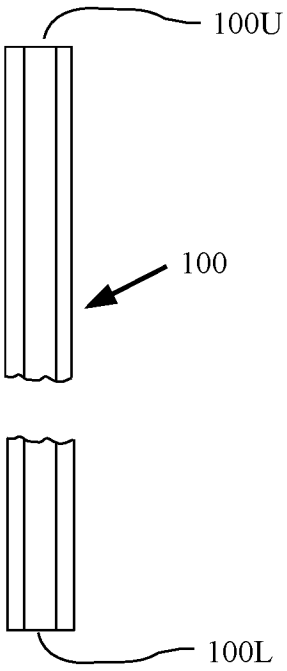
FIG. 34A is a side view of the panel of FIG. 34.
Figure 34B:
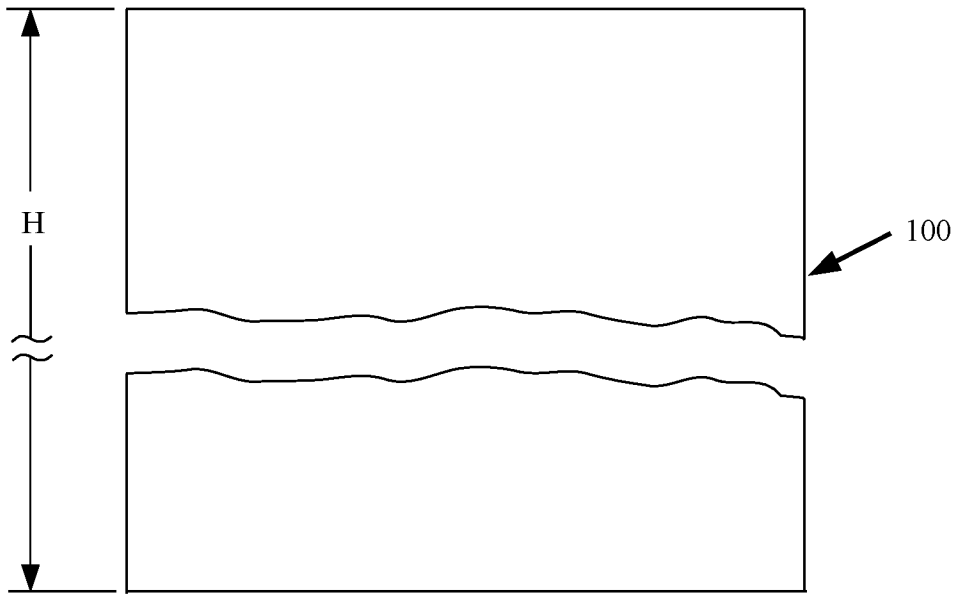
FIG. 34B is a front view of the panel of FIG. 34A.
Figure 34C:
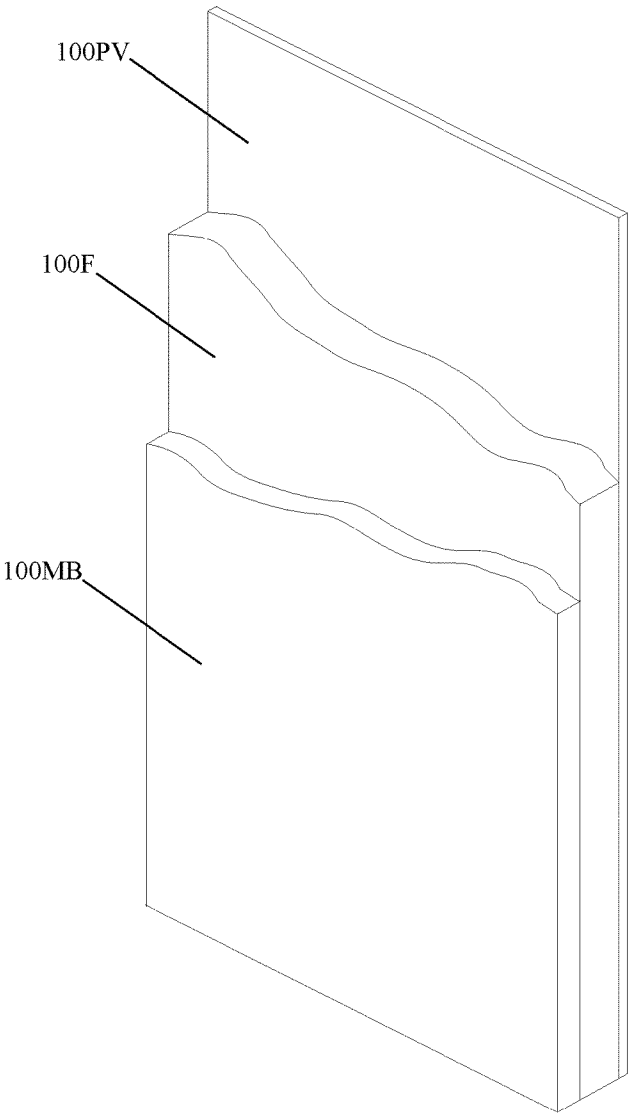
FIG. 34C is a perspective view of the composite panel of FIG. 34.

At this point in the installation, the framing members attached to the concrete walls are still not covered. However, FIG. 34 is the same cross-sectional view of FIG. 33, but also shows a panel 100 of the present invention with its upper end 100U initially being inserted behind the crown molding 70. Different panel materials may be used, but in one embodiment the panel used for the present invention, as shown in detail in FIGS. 34A-34C, may be a composite panel that may include a three mm thick Magnesium Oxide board 100MB, a one mm PVC backing sheet 100PV, and sandwiched therebetween may be a closed cell Polyisocyanurate foam 100F, which may have a fire retardant built into it. The magnesium oxide board 100MB may serve as sheathing, as a drywall replacement, and offers improved characteristics including tire, mold, and mildew resistance, and greater strength. These composite panels may be cut as required using a skill saw or jig saw with a downward blade.

To ensure that the top corner of the panel 100 does not get caught by, or hung up on, the corner of the base 23 of receiver 20, the top of the panel may be radiused or chamfered, and/or the lower corner of the base 23 of receiver 20 may also taper down to a substantially small thickness (i.e., 0.010 inches) or may even taper down into a "knife edge."

Figure 35:
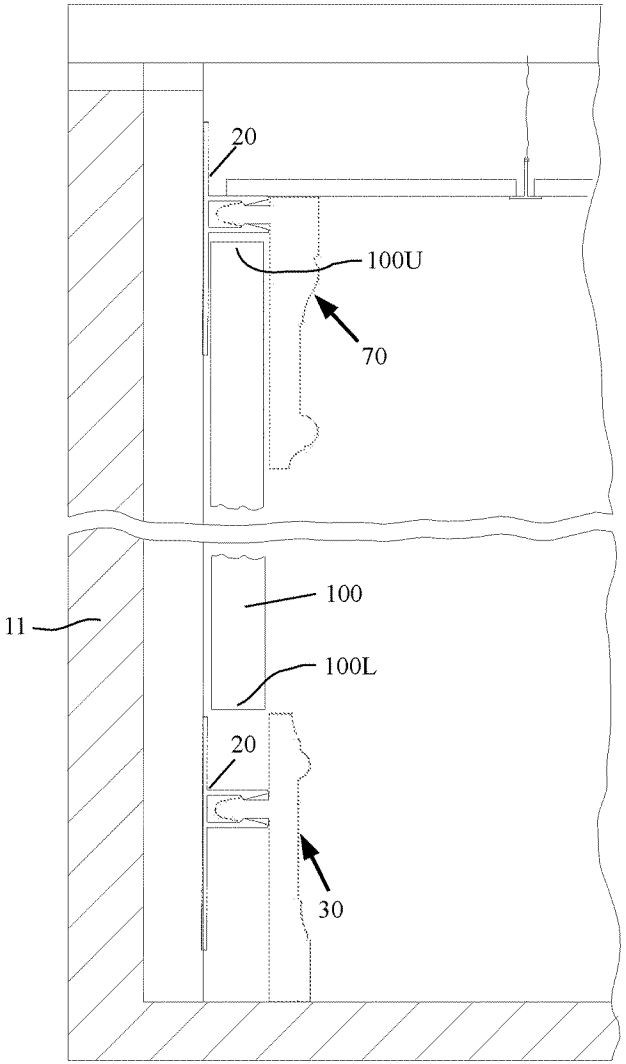
FIG. 35 is the cross-sectional view of FIG. 34, showing the upper end of the panel fully inserted behind the crown molding, and with the panel generally parallel with the wall and above the base molding.

FIG. 35 shows the upper end 100U of the panel 100 fully inserted behind the crown molding 70, and with the panel generally parallel with the wall 11 and with its lower end 100L positioned above the base molding 30.

Figure 36:
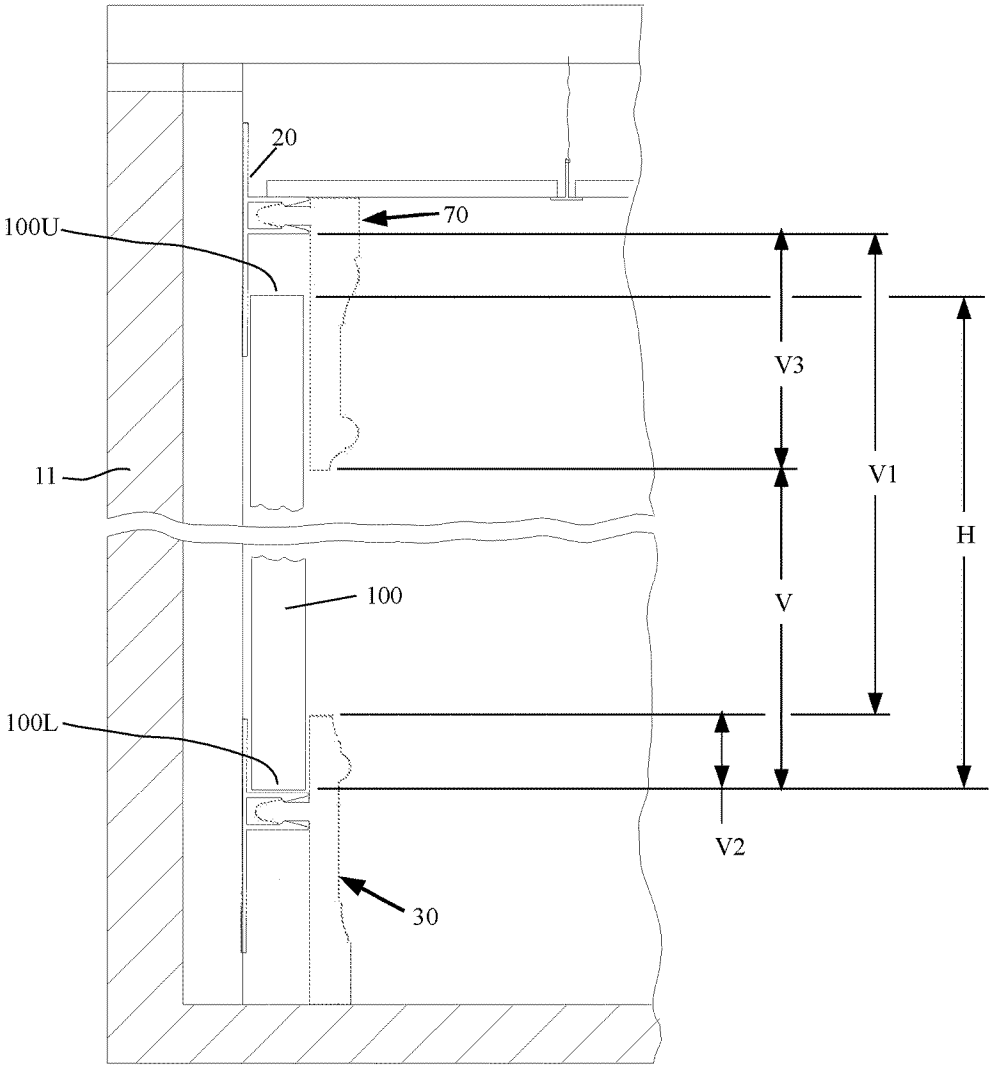
FIG. 36 is the cross-sectional view of FIG. 35, after the panel has been lowered for its bottom portion to be nested behind the base molding.

FIG. 36 shows the panel 100 after it has been lowered, for its bottom portion 100L to be nested behind the base molding 30 in contact with the upper flange of the receiver strip 20, to produce the finished wall section.

For the panel 100 to be able to cover the exposed wall 11, the height H of the panel should be greater than the opening V between the bottom of the crown molding 70 and the top of the base molding 30, as shown in FIG. 36. Also, to be able to slide the bottom 100L of panel 100 over the top of the base molding 30, as seen in FIGS. 35 and 36, the height H of the panel 100 should be smaller than the distance V1 between the top of the base molding 30 and the bottom-most flange of the receiver strip 20 mounted at the upper wall location, and also, the distance V3 from the bottom of the crown molding 70 to the lower flange of the upper receiver strip 20 should be greater than the distance V2 between top of the base molding 30 and the upper flange of the lower receiver strip 20 (i.e., V3>V2).

Multiple panel sections may be needed to laterally cover the full extent of a wall, and any vertically oriented panel-to-panel joint may be concealed using a floor-to-ceiling trim piece that may be secured to one or both of the panels at the joint using for example, but not limited to, adhesive, nails, screws, etc.

Where a chair rail molding is utilized, two separate panels would similarly be installed to complete the finished wall. Typical panel sizes would be a 64"×48" top panel and a 32"×48" bottom panel. The receiver strip 20 for the chair rail may thus be appropriately positioned to accommodate those standard panel sizes.

The disclosed arrangement permits easy access behind the wall panels, if necessary to effect repairs to electrical wiring, or to add wiring, etc., simply by removing the panel in a reverse manner (i.e., by raising the panel 100, by angling its lower end 100L outwardly, and by next removing the upper end of the panel 100U from behind the crown molding 70). The moldings may also be readily removed, if necessary, particularly where a non-ninety-degree angle is used for the surfaces 24B and 25B on the receiver strips 20, which may help facilitate the outward deflection of the flanges 24 and 25 needed to dislodge the flange 37.

It should also be noted that the disclosed arrangement may similarly be utilized for the above-grade finishing of a framed room, rather than using drywall.

Additionally, in an alternate embodiment, the receiver strips 20 may be mounted directly to a concrete wall without any wood framing, using concrete nails. In this embodiment, the PVC backing 100PV of the panel 100, being a strong but light-weight plastic, may be suitably positioned to face the rough concrete.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

What is claimed is:

1. A modular wall panel system comprising:

a first receiver strip and a second receiver strip configured to respectively be secured to a selective upper position and lower position on a wall, each said receiver strip comprising:

an elongated base;

a first flange and a second flange spaced a first distance (G2) apart; each of said first and second flanges configured to cantilever a second distance (P) from said base to a free end thereof; each of said first and second flanges comprising:

a first tapered surface extending away from said free end and a second tapered surface extending from said first tapered surface to form a respective apex positioned at a third distance (T) from said free end;

wherein said apex on said first flange is positioned thereon to be disposed towards said second flange, and said apex on said second flange is positioned thereon to be disposed towards said first flange; and wherein said apex of said second flange is positioned at a fourth distance (G) away from said apex of said first flange;

a base molding having a bottom surface, a rear surface, and a sculpted surface, said base molding comprising a mating flange configured to cantilever a fifth distance (L) from said rear surface to a free end thereof, said mating flange configured to be mated between said first and second flanges of said second receiver strip at the selective lower wall position; said mating flange comprising:

a flange member protruding from said rear surface, formed by a first pair of flange surfaces spaced at least a sixth distance (W) apart;

a pair of wedge surfaces that converge to create a wedge shape configured to taper down toward said free end of said mating flange;

a second pair of surfaces that converge beginning from a wide end of said wedge shape, down toward said first pair of flange surfaces, to join said first pair of flange surfaces at a seventh distance (D) from said rear surface; and a first apex and a second apex formed by said converging wedge surfaces and said converging second pair of surfaces, with said first and second apices each positioned an eighth distance (W2) apart from each other;

a crown molding having a top surface, a rear surface, and a sculpted surface, said crown molding comprising a mating flange configured to be mated between said first and second flanges of said first receiver strip selectively positioned at the upper wall position; said mating flange of said crown molding formed substantially the same as said mating flange for said base molding;

a panel, said panel comprising a length, said length configured for a top of said panel to be inserted behind said rear surface of said crown molding, when mated with said receiver strip at said selective upper wall position, and for a bottom of said panel to be subsequently inserted behind said rear surface of said base molding, when mated with said receiver strip at said selective lower wall position, for said panel to be releasably positioned in proximity to the wall, with said panel supported above the floor by said first flange of said second receiver strip, and with said top of said panel and said bottom of said panel respectively covered by said-crown molding and said floor molding;

wherein said panel is a composite panel comprising: a magnesium oxide board, a backing sheet, and a foam material sandwiched between said board and said backing sheet; and wherein said backing sheet is formed of a polyvinylchloride material, and said foam material is a closed cell polyisocyanurate foam.

2. The modular wall panel system according to claim 1 wherein said seventh distance (D) of said first and second apices from said rear surface of said molding is equal to or greater than said third distance (T) of said apices from said free end of said first and second flanges of said receiver strips.

3. The modular wall panel system according to claim 2 wherein said eighth distance (W2) between said first and second apices of said mating flange of each of said moldings is equal to or less than said first distance (G2) between said first and second flanges of each said receiver strip.

4. The modular wall panel system according to claim 3 wherein said sixth distance (W) for said spacing for said first pair of flange surfaces of each said molding is less than or equal to said fourth distance (G) between said apices of said first and second flanges of each said receiver strip.

5. The modular wall panel system according to claim 4 wherein said fifth distance (L) of said mating flange of each said molding is equal to or less than said cantilevered second distance (P) of each of said first and second flanges of said receiver strips.

6. The modular wall panel system according to claim 5 wherein said second pair of surfaces on said flange member of said moldings is formed at an angle ($\alpha 2$) with respect to said first pair of flange surfaces, with said angle ($\alpha 2$) being substantially the same as an angle ($\alpha$) between said second tapered surface and said cantilevered flanges of said receiver strips.

7. The modular wall panel system according to claim 6 wherein each said surface of said pair of wedge surfaces that converge to create a wedge shape on said flange member of said moldings is formed at an angle ($\theta 2$) with respect to said first pair of flange surfaces, with said angle (θ2) being substantially the same as an angle (θ) between said first tapered surface and said cantilevered flanges of said receiver strips.

8. The modular wall panel system according to claim 7 wherein said angle (α) is approximately 50 to 60 degrees.

9. The modular wall panel system according to claim 8 wherein said angle (θ) is approximately 15 to 20 degrees.

10. The modular wall panel system according to claim 7 wherein each said receiver strip is formed of a polyvinylchloride material.

11. The modular wall panel system according to claim 10 wherein said base molding and crown molding is formed of a celuka polyvinylchloride.

12. The modular wall panel system according to claim 11 wherein said first and second flanges of each said receiver strip protrude orthogonally from said base of each said receiver strip.

13. The modular wall panel system according to claim 12 wherein said first and second flanges of each said receiver strip protrude from said base along an entire length of said base.

14. The modular wall panel system according to claim 13 wherein said first and second flanges of each said receiver strip protrude intermittently from said base.

15. A modular wall panel system comprising:

a first receiver strip and a second receiver strip configured to respectively be secured to a selective upper position and lower position on a wall, each said receiver strip comprising an elongated base, and a first flange and a second flange, with each said flange configured to protrude a selective distance away from said elongated base;

a base molding comprising a mating flange configured to extend a selective distance away from a rear surface of said molding, and to protrude at a selective height above a bottom surface of said base molding; said mating flange configured to releasably mate with said first and second flanges of said second receiver strip; said selective lower position configured to locate said first and second flanges of said mounted second receiver strip to correspond to said selective height of said mating flange, to position said bottom surface of said base molding in proximity to a floor;

a crown molding comprising a mating flange configured to extend a selective distance away from a rear surface of said crown molding, and to protrude at a selective height below a top surface of said crown molding; said mating flange of said crown molding configured to releasably mate with said first and second flanges of said first receiver strip; said selective upper position configured to locate said first and second flanges of said mounted first receiver strip to correspond to said selective height below said top surface of said mating flange of said crown molding, to position said top surface of said base molding in proximity to a ceiling;

a panel, said panel comprising a length, said length configured for a top of said panel to be inserted behind a portion of said rear surface of said crown molding, when mated with said receiver strip at said selective upper wall position, and for a bottom of said panel to be subsequently inserted behind a portion of said rear surface of said base molding, when mated with said receiver strip at said selective lower wall position, for said panel to be releasably positioned in proximity to the wall, with said panel supported above the floor by said first flange of said second receiver strip, and with said top of said panel and said bottom of said panel respectively covered by said crown molding and said floor molding;

wherein said panel is a composite panel comprising: a magnesium oxide board, a backing sheet, and a foam material sandwiched between said board and said backing sheet; and wherein said backing sheet is formed of a polyvinylchloride material, and wherein said foam material is a polyisocyanurate foam.

* * * * *